US008497813B2

(12) United States Patent
Rodger et al.

(10) Patent No.: US 8,497,813 B2
(45) Date of Patent: Jul. 30, 2013

(54) PANEL ANTENNA HAVING SEALED RADIO ENCLOSURE

(75) Inventors: Derek Rodger, Fife (GB); Matthew Ferris, Plano, TX (US)

(73) Assignee: Andrew LLC, Hickory, NC (US)

( * ) Notice: Subject to any disclaimer, the term of this patent is extended or adjusted under 35 U.S.C. 154(b) by 570 days.

(21) Appl. No.: 12/792,367

(22) Filed: Jun. 2, 2010

(65) Prior Publication Data

US 2011/0032158 A1 Feb. 10, 2011

Related U.S. Application Data

(63) Continuation-in-part of application No. PCT/US2009/066345, filed on Dec. 2, 2009.

(60) Provisional application No. 61/119,114, filed on Dec. 2, 2008.

(51) Int. Cl.
*H01Q 1/42* (2006.01)

(52) U.S. Cl.
USPC ..... 343/872; 343/702

(58) Field of Classification Search
USPC ..... 343/700, 702, 872, 873
See application file for complete search history.

(56) References Cited

U.S. PATENT DOCUMENTS

| | | | | |
|---|---|---|---|---|
| 3,495,173 | A * | 2/1970 | Harner et al. | 324/127 |
| 5,828,339 | A * | 10/1998 | Patel | 343/700 MS |
| 6,259,933 | B1 * | 7/2001 | Bambridge et al. | 455/557 |
| 6,414,867 | B2 * | 7/2002 | Suzuki et al. | 363/141 |
| 2002/0065052 | A1 * | 5/2002 | Pande et al. | 455/67.5 |
| 2005/0104792 | A1 | 5/2005 | Asao et al. | |
| 2006/0109188 | A1 | 5/2006 | Ikeda et al. | |
| 2006/0250311 | A1 | 11/2006 | Bishop | |
| 2007/0001919 | A1 | 1/2007 | Carroll et al. | |
| 2008/0252552 | A1 | 10/2008 | Goebel et al. | |

FOREIGN PATENT DOCUMENTS

| | | | |
|---|---|---|---|
| WO | WO 2005-069432 | A1 | 7/2005 |
| WO | WO 2006-119454 | A1 | 11/2006 |
| WO | WO 2009/011601 | A1 | 1/2009 |
| WO | WO 2009-011601 | A1 | 1/2009 |

OTHER PUBLICATIONS

International Search Report and Written Opinion regarding PCT/US2010/03788.

(Continued)

*Primary Examiner* — Tho G Phan
(74) *Attorney, Agent, or Firm* — Husch Blackwell LLP

(57) ABSTRACT

A panel antenna having an enclosure, an internal cover, one or more micro radios and RF modules, and a radome is provided. The enclosure may include a rectangular rear panel, side walls with an interior surface to mount micro radios and an external surface to receive heat sinks, and a hinged front cover providing an internal cover. The internal cover may also have a plurality of RF radiating modules fastened thereto. The internal cover may also provide environmental sealing and electromagnetic shielding. The plurality of micro radios are located inside the cavity of the enclosure, and each micro radio is coupled to an RF radiating module. The micro radios may be mounted inside the enclosure on the side walls. The radome encloses the RF radiating modules. The radome may be mounted to the internal seal. Additionally, the panel antenna may further include a heat sink mounted on an exterior side of the rear panel. The heat sink on the rear panel may dissipate heat from additional active electronics, such as a communications hub or calibration radio. The micro radios and active electronics may be mounted such that the heat sinks dissipate heat generated by the micro radios.

17 Claims, 10 Drawing Sheets

OTHER PUBLICATIONS

International Search Report and Written Opinion regarding PCT/US2009/066345.

International Search Report and Written Opinion regarding international application PCT/US2009/066345.

Supplementary European Search Report for related Application No. EP 09 83 1021 dated Jul. 4, 2012.

PCT Written Opinion for PCT/US2010/037088 dated Jun. 14, 2012.

* cited by examiner

PANEL ANTENNA HAVING SEALED RADIO ENCLOSURE

FIELD OF THE INVENTION

The field of the invention relates generally to panel antennas used in communications applications. More particularly, the field of the invention relates to arrangements of passive and active antenna components in an multiple radiating element panel antenna.

BACKGROUND OF THE INVENTION

A typical known Cellular Telephone Base Station System comprises several elements, including one or more panel antennas, each panel antenna comprising an array of radiating elements mounted at an elevation above the ground, and base station electronics mounted remotely from the antenna arrays. The known antenna arrays typically include a plurality of radiating elements and a feed network. The radiating elements and feed network may be mounted on a panel antenna plate. See, e.g., U.S. Pat. No. 6,034,649, titled Dual Polarized Base Station Antenna. In some antennas, a ground plane for the radiating elements may be used as a part of the antenna structure. In some known panel antennas, the feed network may include power dividers, phase shifters, or other circuit devices for adjusting beam width and/or beam direction. Typically, however, such known panel antennas have feed networks which comprise passive components, and do not have active devices which perform power amplification.

Typically, the known panel antennas are driven by a Low Noise Amplifier (LNA). A LNA may be mounted on support structure for the panel antenna or located as part of a base station, comprising an environmental enclosure on the ground below the panel antenna. The LNA may be coupled to the feed network of the panel antenna by coaxial cable. Locating the LNA in the environmental enclosure at the base station facilitates protecting active electronics from the elements. However, such an arrangement also requires extensive cabling from the base station environmental enclosure to the location of the panel antenna, which may be located at a significant elevation above the base station.

Another type of panel antenna is one where individual radio elements are associated with the radiating elements. For example, international patent application WO 2008/1009421, titled "Antenna Array System," discloses an all-digital antenna array. WO 2008/1009421 is incorporated by reference. In the '421 application, a digital signal is provided to a Communications Hub. The Communications Hub distributes the digital signal to a plurality of micro radios. An antenna radiating element is associated with each micro radio. However, the '421 patent application does not consider or solve certain issues with packaging and antenna design.

For example, in prior art remote radio head antennas, the components in the panel antenna are passive and heat dissipation is not an issue. In the '421 application, however, each micro radio has a power digital to analog converter for converting the digital signal into an RF signal. This power converter generates a significant amount of heat that must be dissipated. The '421 application does not teach or suggest a way to solve the heat dissipation problem. Additionally, locating active electronic components, including power amplifiers in the panel antenna raises substantial issues regarding protecting such electronics from adverse environmental conditions, such as rain and other forms of precipitation. Protection from environmental conditions is not solved in the '421 application. Also, the '421 application does not address issues concerning electromagnetic interference, manufacturing assembly and serviceability.

SUMMARY OF THE INVENTION

According to one example of the present invention, a panel antenna may include an enclosure, an internal cover, one or more micro radios and RF modules, and a radome. The internal cover is dimensioned to overlap an aperture in the enclosure. The aperture provides access to a cavity of the enclosure. The enclosure may include a rectangular rear panel, side walls with an interior surface to mount micro radios and an external surface to receive heat sinks, and a hinged front cover providing an internal cover. The internal cover may also have a plurality of RF radiating modules fastened thereto. The internal cover may also provide environmental sealing and electromagnetic shielding. The plurality of micro radios are located inside the cavity of the enclosure, and each micro radio is coupled to an RF radiating module. The micro radios may be mounted inside the enclosure on the side walls. The radome encloses the RF radiating modules. The radome may be mounted to the internal seal.

Additionally, the panel antenna may further include a heat sink mounted on an exterior side of the rear panel. The heat sink on the rear panel may dissipate heat from additional active electronics, such as a communications hub or calibration radio. The micro radios and active electronics may be mounted such that the heat sinks dissipate heat generated by the micro radios.

In alternate examples of the present invention, a panel antenna may include an enclosure, an internal cover, a plurality of micro radios and RF modules, and a radome. The enclosure may include a rectangular rear panel, and, extending in a longitudinal direction of the enclosure, first walls extending from at least the longitudinal edges of the rear panel, second walls extending from the first walls and being angled inwardly, third walls extending from the second walls, and flange extending from the third wall portion outwardly from the cavity of the enclosure, the flange being substantially parallel with the rear panel, the flange having a mounting locations and a sealing area located between the mounting locations and the third wall portion. The first and third walls may be generally perpendicular to the rear panel. The internal cover may be dimensioned to overlap an area defined by the flange of the enclosure such that the internal cover forms an environmental seal when positioned on the sealing area of the flange. The internal cover may also have a plurality of RF radiating modules fastened thereto. The internal cover may also provide electromagnetic shielding. The plurality of micro radios are located inside the cavity of the enclosure, and each micro radio is coupled to an RF radiating module. In one example, the micro radios are mounted on the rear panel. In an alternate embodiment, the micro radios may be mounted on the first and third walls. The radome encloses the RF radiating modules.

Additionally, the panel antenna may further include a heat sink mounted on an exterior side of the rear panel. The micro radios may be mounted such that the heat sinks dissipate heat generated by the micro radios. The ends of the enclosure may be substantially flat end walls, or the shape of the longitudinal walls may be carried through to one or both of the ends of the enclosure.

A panel antenna according to another alternate example of the present invention includes an enclosure, a radome assembly, and a plurality of micro radios protected by the enclosure and the radome assembly. The enclosure may have a rear panel, a first wall portion extending from the rear panel, a second wall portion and a third wall portion, and a flange extending outwardly from the third wall portion. The second wall portion is angled inwardly toward a cavity of the enclosure, the flange having a mounting locations and a sealing area located between the mounting locations and the third wall portion. The radome assembly may have a radome, a plurality of RF radiating modules fastened thereto, and a seal element located around a periphery of a cavity of the radome. The seal element on the radome assembly may be adapted to form a seal with the sealing area of the flange. Alternatively, the radome assembly may be attached to the enclosure by a hinge. The plurality of micro radios are located inside the enclosure, and each micro radio is coupled to one of the plurality of RF radiating modules. A plurality of micro radios may be located on a micro radio module. In one alternative example, the micro radios are mounted on interior surfaces of first and second side walls, and heat sinks are mounted on exterior surfaces of the side walls.

The present invention provides a digital Base Station Antenna that provides for protecting a plurality of micro radios from environmental conditions while providing a mechanically rigid, readily serviceable panel antenna.

DETAILED DESCRIPTION OF THE PRESENT INVENTION

Figure 1:
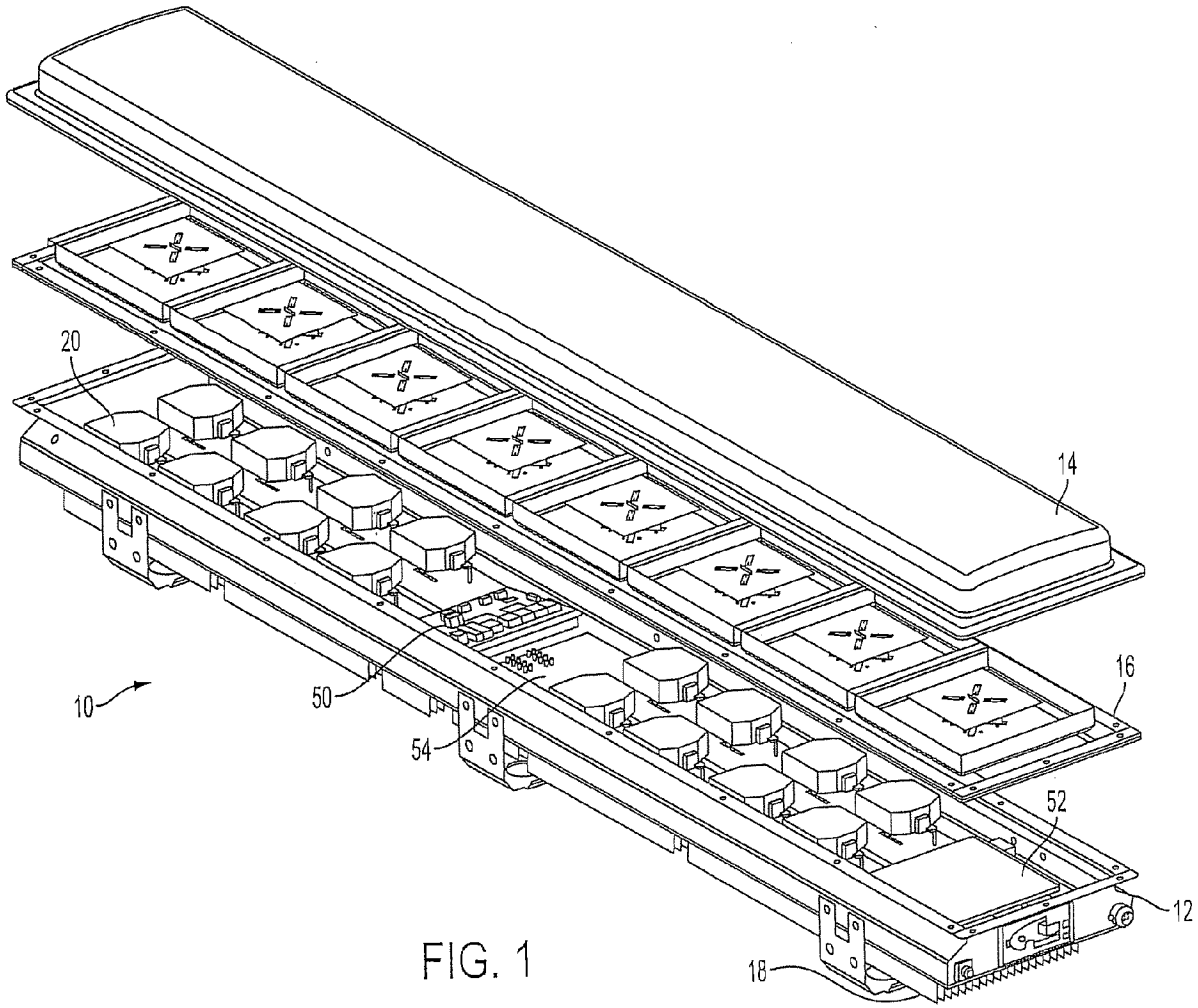
FIG. 1 is an illustration of the components of one example of a panel antenna according to the present invention.

Referring to FIG. 1, in one example, a Panel Antenna 10 comprises an enclosure 12, internal cover 14, radome 16 and rear heat sinks 18. As described in more detail below, the enclosure 12 may be formed from sheet metal. The Panel Antenna 10 may include a plurality of micro radios 20 mounted within the enclosure 12. The micro radios 20 may be thermally coupled to the rear heat sinks 18. In one aspect of the invention, described in more detail below, the internal cover 14 may include a plurality of RF modules 24.

Figure 2:
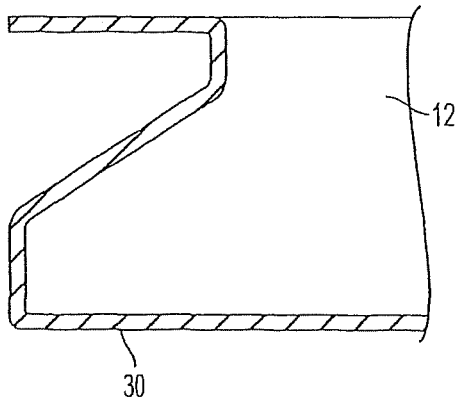
FIG. 2 is a cross-sectional diagram of one example of a housing according to the present invention.
Figure 3:
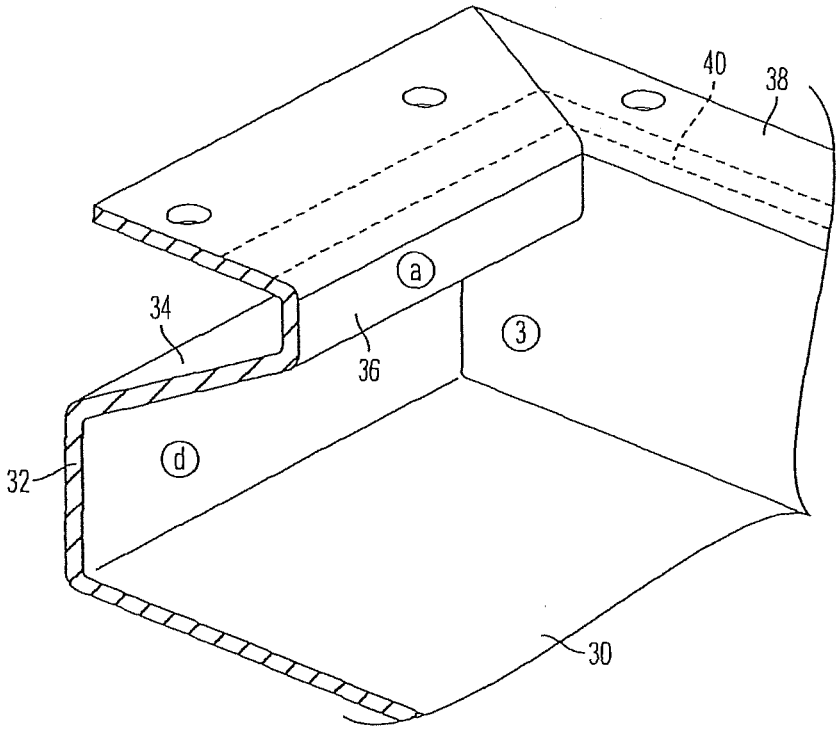
FIG. 3 is an isometric view of a part of one example of a housing according to the present invention.

Referring to FIGS. 2 and 3, the enclosure 12 comprises a rear panel 30, a lower side wall 32, an angled side wall 34, an upper side wall 36, and a flange 38. In one example, lower side wall 32 and upper side wall 36 are perpendicular to rear panel 30 and flange 38 is parallel to the rear panel 30. Angled side wall 34 is angled toward the interior of the enclosure. The rear panel 30, side walls 32, 34, 36 and flange 38 may be formed from sheet metal. Corners, formed at the junctions of the walls may be welded. Welded corners have the benefit of preventing moisture from entering the enclosure via the corners.

The combination of the rear panel 30, lower side wall 32, inclined side wall 34, upper side wall 36, and flange 38 may be configured such that these elements, when viewed in cross section, appear in a Z-shape. In one example of the invention, this Z-shape arrangement is employed on two longitudinal sides of the enclosure, and end walls 37 are flat. In alternative examples, the Z-shape may be employed on three sides of the enclosure (e.g., two longitudinal sides and an end) or on all four sides of the enclosure. The Z-shape provides improved structural rigidity over conventional box-style structures.

In addition to enhancing rigidity, a Z-shaped sidewall enclosure provides enhanced internal space for a given outer flange dimension. For example, for a given flange dimension, the Z-shaped enclosure has more interior volume than a conventional box enclosure having an outward-turned flange of the same dimensions. An inward-turned flange may be used, however, such a flange may have additional challenges regarding sealing against adverse environmental conditions, especially moisture. Additionally, a radome may be configured to slide over and engage the outward-turned flanges, which allows installation and removal of a radome without installing or removing fasteners. This may be advantageous when servicing a Panel Antenna 10 located on a communications tower.

Flange 38 may be flat and parallel to the rear panel 30. In one example, a flat flange 38 provides an area for facilitating a seal between flange 38 and internal cover 14. In this example, flange 38 includes sealing area 40. Flange 38 may also include a fastening system for the internal cover 14.

In one example, the sealing area is located between the fastening system and a peripheral opening defined by upper side walls 36. In this example, locating the fasteners on the flange 38 outside the sealing area eliminates the need for the fasteners themselves to be sealed or to be of a sealable design. Thus, many options are available for the fasteners. Additionally fasteners may be added after the sheet metal has been finished (e.g., painted, coated).

The Panel Antenna 10 includes a communications hub 50, a power supply 52, and a calibration radio 54. In the illustrated example, interconnections between the communications hub, power supply, and calibration radio are protected from adverse environmental conditions by the enclosure 12, internal cover 14, and sealing area 40.

In the example illustrated in FIG. 1, eight RF modules 24 and sixteen micro radios 20 (each with a duplexer) are shown. Each RF module 24 is coupled to a corresponding pair of micro radios 20. In this example, a first micro radio 20 of a pair of micro radios drives a first radiating element of the corresponding RF module 24, and a second micro radio 20 of the pair of micro radios drives a second radiating element of the corresponding RF module 24. This arrangement may be used, for example, where the RF modules 24 comprise dual polarized radiating elements.

Each micro radio 20 is also connected to the communications hub 50. The communications hub 50 is connected to Base Station Equipment (BSE) (not illustrated). A digital signal may be provided by the Base Station Equipment to the communications hub 50. For example, a fiber optic link or other digital transmission medium may provide the connection between the BSE and the communications hub 50. Typically, the communications hub receives digital signals from the BSE, comprising information for RF transmission by the Panel Antenna 10, and transmits digital signals to the BSE, comprising information received by RF signal by the Panel Antenna 10.

The connection between the communications hub 50 and each micro radio 20 may also be digital. In one example, the communications may comply with the SerDes standard. The communications hub 50 sends signals to the micro radios 20 for RF transmission, and receives signals from the micro radios 20 that correspond to RF signals received by the RF modules 24 and the micro radios 20. The communications hub 50 may also perform amplitude and phase adjustment to control attributes of RF transmission or reception. When amplitude and phase adjustment is performed electronically, a conventional feed network having electro-mechanical power dividers and phase shifters need not be included.

In one example, a micro radio 20 may comprise a Digital Up Converter, a power Digital to Analog Converter (including a digital to RF converter). The micro radio may comprise a duplex radio, in which case it may also include a Time Division Duplex Switch, a Low Noise Analog to Digital Converter (including an RF to digital converter) and a Digital Down Converter. A Time Division Duplex Filter couples the Time Division Duplex Switch to a RF module.

Internal cover 14 may be manufactured from a sheet of aluminum. Other materials may be used for internal cover 14. In the illustrated example, aluminum is selected because the material serves to provide both an environmental seal and an electromagnetic shield. In this example, internal cover 14 protects the micro radios 20 and other electronics in the Panel Antenna 10 from moisture and other environmental hazards, and shields the micro radios 20 and other electronics from the electromagnetic transmissions of the RF modules 24. The RF modules 24, as passive devices, need not be as effectively sealed from the elements as the active electronics. RF signals are carried between the RF modules 24 and micro radios 20 on cables (not shown). The cables may pass through sealed apertures in the internal cover 14.

The internal cover 14 may also serve as a structural support for the RF modules 24. The RF modules may include a plurality of radio frequency radiating elements. In one illustrated example, the internal cover 14 supports eight RF modules 24. In one example, the RF modules 24 comprise patch antennas, and in particular, dual polarized patch antennas. Alternatively, the RF modules may comprise dipole or cross-dipole antenna elements. In some embodiments, radiating elements may be disposed over a pan-shaped reflector. In other embodiments, radiating elements may be disposed over a ground plane.

An example of a suitable patch antenna may be found in International Application WO 2006/135956 A1, which in incorporated by reference. In this example, a patch radiator is positioned above a ground plane and excited such that a dual polarized RF signal is produced. This may be accomplished by exciting opposite sides of the radiator in antiphase.

The internal cover 14 may be drilled to match the enclosure 12, so that mounting hardware may join the internal cover 14 to the enclosure 12. A seal 62 may be located over the studs in the aluminum frame. Alternatively, the seal may be located inside a periphery defined by the studs. Alternatively, two seals may be provided, a first seal over the studs, and a second seal inside a periphery defined by the studs.

The radome 16 may include flanges (not illustrated) to engage and slide over edges defined by the flange of the enclosure 12, or the edges of the internal cover 14, or both. Alternatively the radome 16 includes mounting apertures (not illustrated) through which fastening devices may pass.

Figure 4:
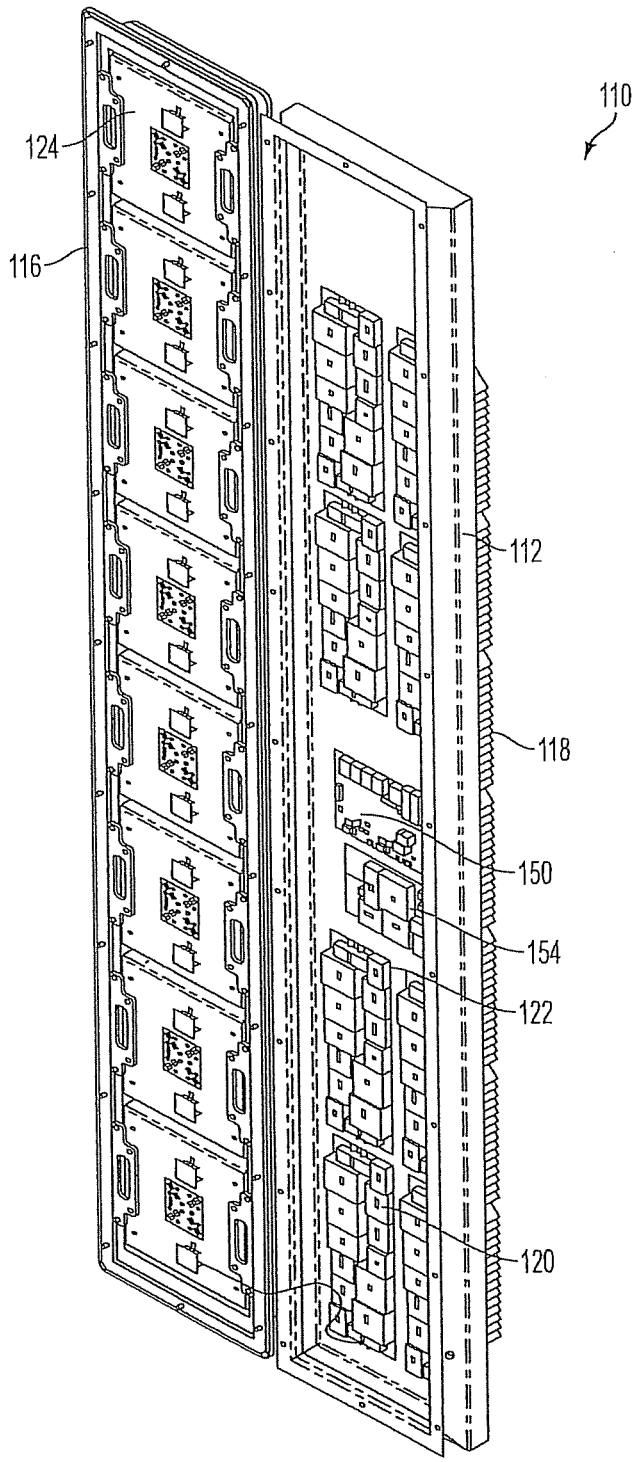
FIG. 4 illustrates another example of a panel antenna according to the present invention with the radome assembly detached.
Figure 5:
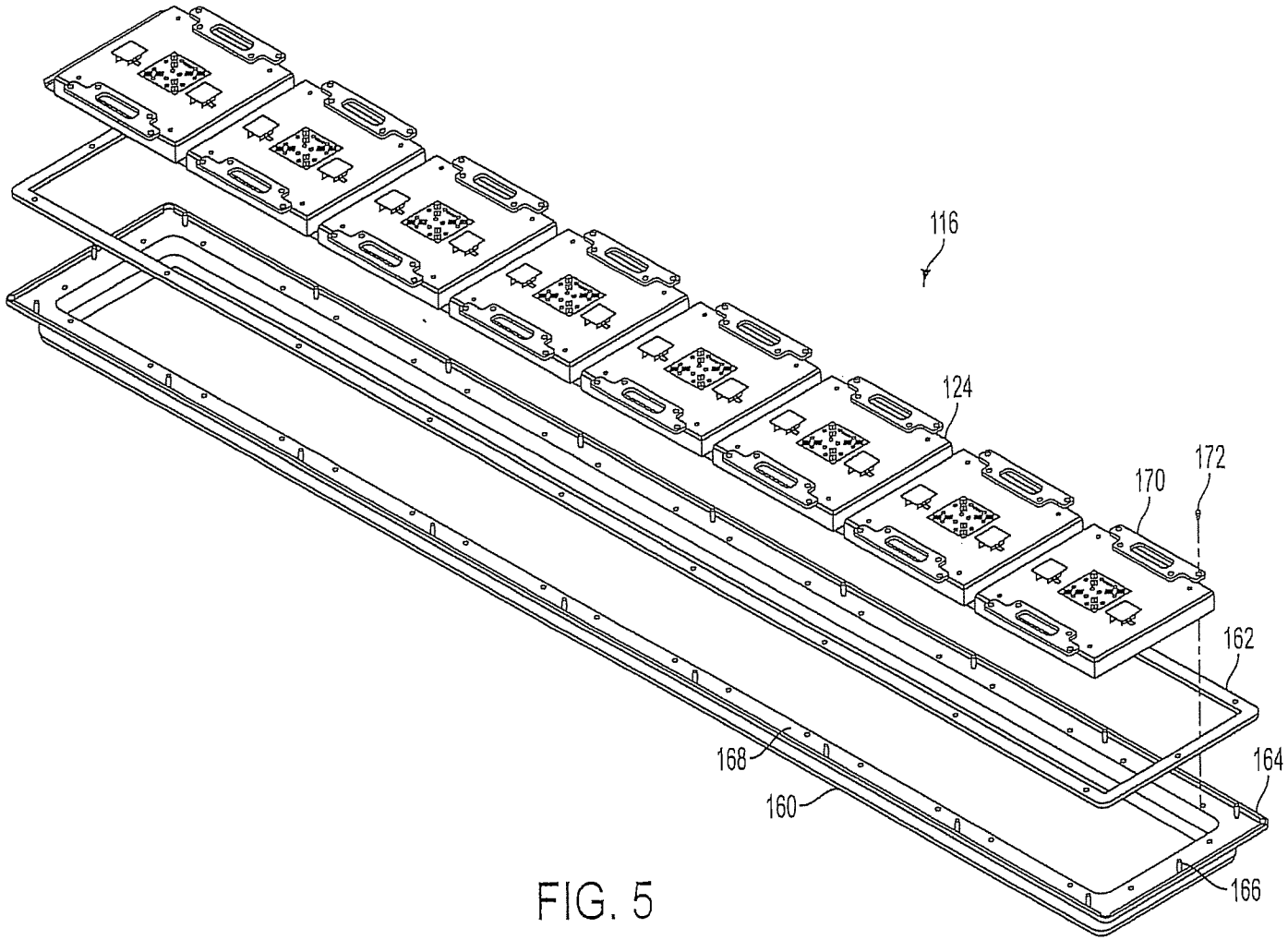
FIG. 5 is an illustration of the components of one example of a radome assembly according to the present invention.

Referring to FIGS. 4 and 5, another example of a Panel Antenna 110 is provided. In this example of the invention, Panel Antenna 110 comprises an enclosure 112, radome assembly 116 and rear heat sinks 118. In this example, enclosure 112 is substantially the same as enclosure 12, the description of which is not repeated herein. Panel Antenna 110 may include a plurality of micro radios 120 mounted within the enclosure 112. The micro radios 120 may be grouped into radio modules 122. The radio modules 122 may be thermally coupled to the rear heat sinks 118. In one aspect of this example, described in more detail below, the radome assembly 116 includes a plurality of RF modules 124.

In FIG. 5, a radome assembly 116 is illustrated. The radome assembly 116 includes a radome 160, a seal 162, and a plurality of RF modules 124. Each RF module 124 may include a plurality of RF elements. The RF elements may comprise individual modules, pairs or other groups of modules, or a plurality of RF elements in a single module. In one illustrated example, the Radome assembly of FIG. 5 includes eight RF modules. Each RF module 124 comprises one group of radiating elements.

In the example illustrated in FIG. 5, four radio modules 122 are shown. Each micro radio module 122 in this example includes two micro radios 120. The radio modules 122 are not limited to two micro radios, and may contain additional micro radios. Each micro radio 120 is connected to a corresponding RF module. Each micro radio 120 is also connected to the communications hub 150. The communications hub is connected to Base Station Equipment. A digital signal may be provided by the Base Station Equipment to the communications hub. A fiber optic link or other digital transmission medium may provide the connection. The connection between the communications hub and each micro radio may also be digital.

The radome assembly 116 may include an aluminum frame 164 with studs 166. In one example, the reflecting elements of the RF modules 124 are integrated with the aluminum frame 164. The seal 162 may be located over the studs in the aluminum frame. Alternatively, the seal may be located inside a periphery defined by the studs. Alternatively, two seals may be provided, a first seal over the studs, and a second seal inside a periphery defined by the studs.

The radome 160 includes mounting locations 168. In one example, the mounting locations 168 may comprise apertures through which fastening devices may pass. In one example, the RF modules 124 are located within the radome 160 with brackets 170 and screws 172, which pass through mounting locations 168. Alternatively, clips or bonding agents may be used to secure the RF modules 124 to radome 160. Providing mounting locations 168 in the radome 160 helps ensure accurate positioning of the RF elements in the radome 160.

In the illustrated example, the RF modules 124 may be installed in the radome 160 to comprise the radome assembly 116. In this arrangement, electronic components, such as the micro radios 120, may be accessed without disturbing the location of the RF modules 124 in the radome 160. However, the RF modules 124 may be removed from the radome assembly 116 if service is required.

As in the earlier-described example, the RF modules 124 may comprise patch antennas, and in particular, dual polarized patch antennas. Alternatively, the RF modules may comprise dipole or cross-dipole antenna elements. In some embodiments, radiating elements may be disposed over a pan-shaped reflector. In other embodiments, radiating elements may be disposed over a ground plane.

Referring to FIGS. 6-9, in another example, a Panel Antenna 210 may include an enclosure 212, internal cover 214, radome 216, rear heat sinks 218 and side heat sinks 219.

The enclosure 212 may be formed from sheet metal such as aluminum or steel. The Panel Antenna 210 may include a plurality of micro radios 220 mounted within the enclosure 212. The micro radios 220 may be thermally coupled to the side heat sinks 219. In one aspect of the invention, described in more detail below, the internal cover 214 may have a plurality of RF modules 224 mounted thereon.

Figure 7:
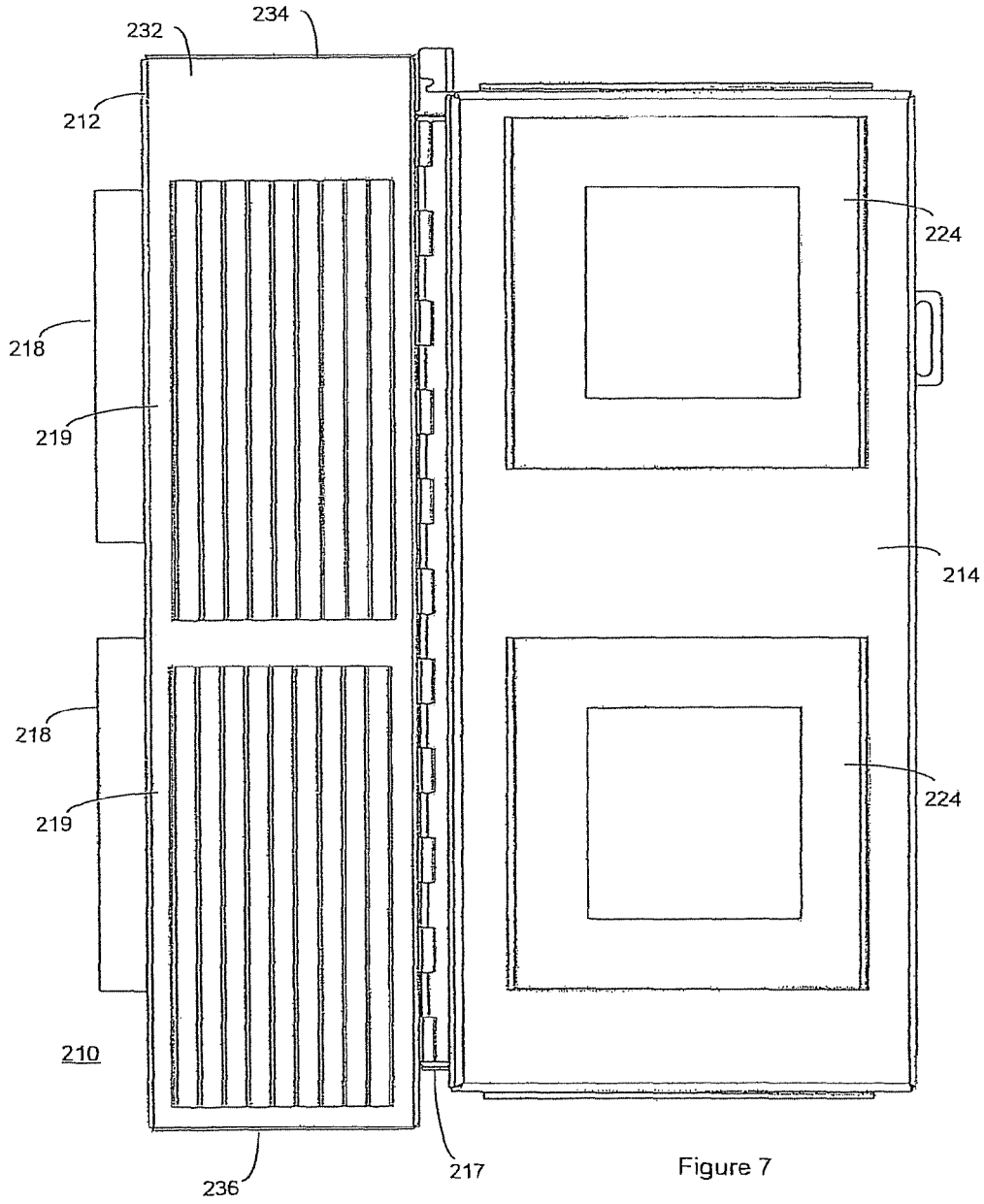
FIG. 7 is a side view of the panel antenna of FIG. 6.
Figure 8:
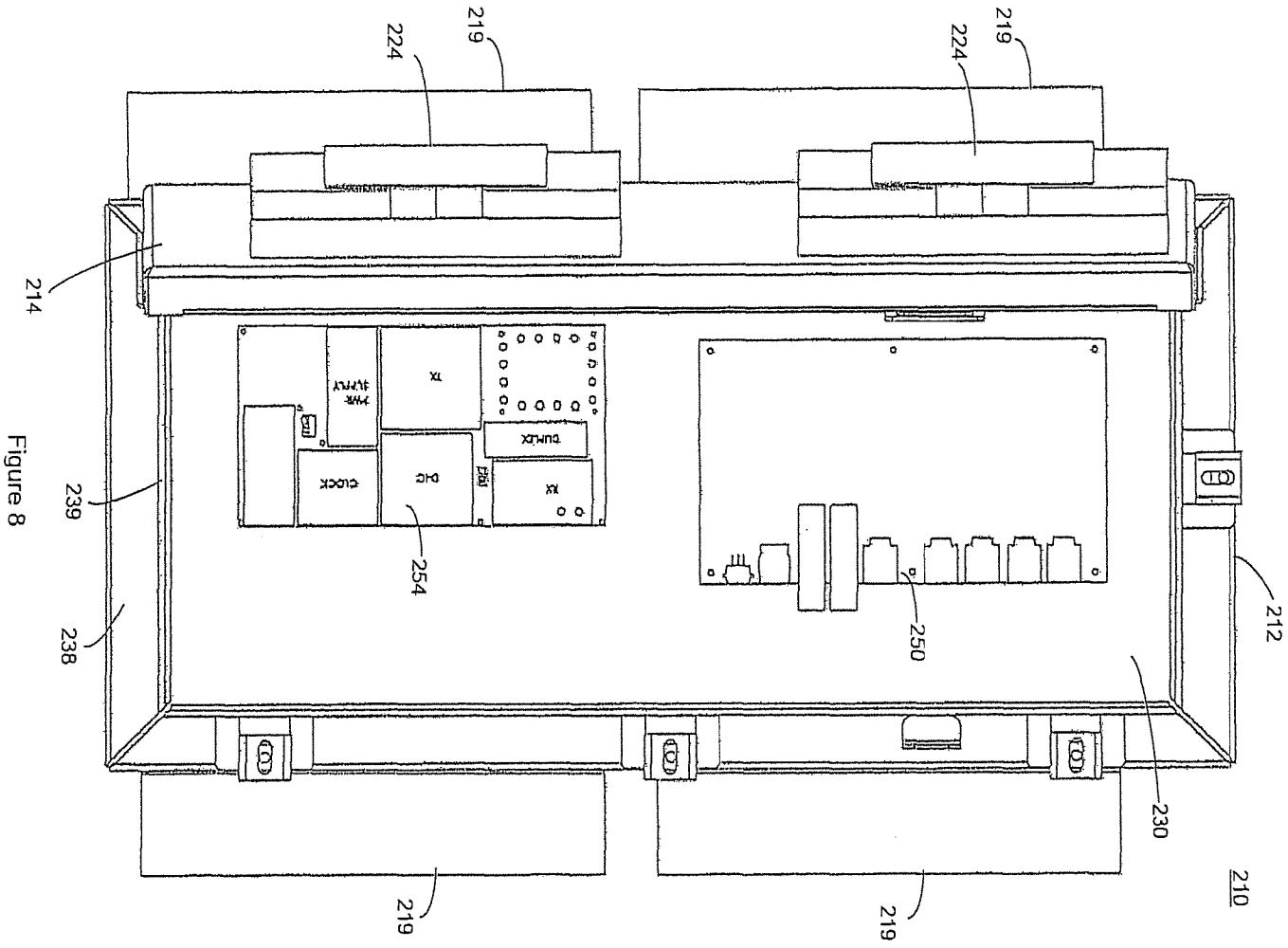
FIG. 8 is a front view of the panel antenna of FIG. 6.
Figure 9:
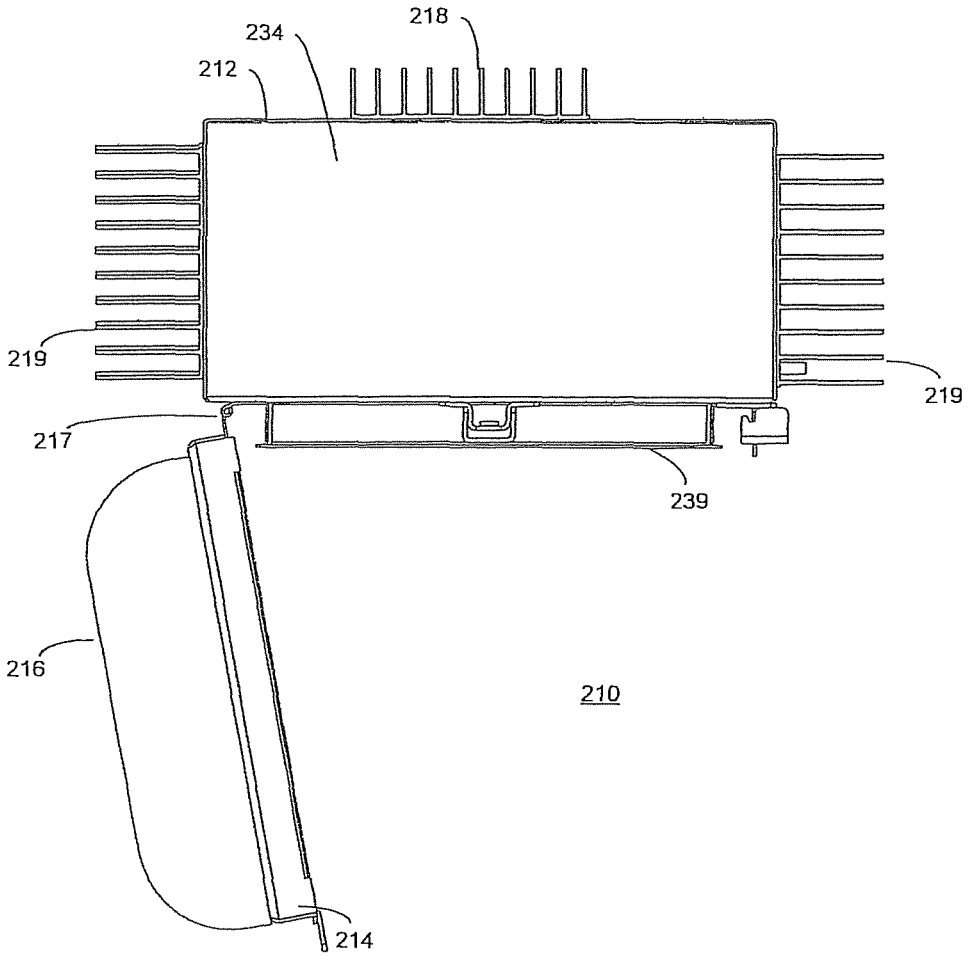
FIG. 9 is a top view of the panel antenna of FIG. 6.

FIGS. 7 and 8 illustrate panel antenna 210 without radome 216 so that RF modules 224 are visible.

The enclosure 212 comprises a rear panel 230, side walls 232, a top wall 234 and a bottom wall 236. While many aspects of the previously described embodiments may be shared with the present embodiment, such as the internal environmental and RF shielding, in this example, a difference is that the side walls 232 are not Z-shaped. Instead, side walls 232 have an area sufficient to mount micro radios 220 to an internal surface and side heat sinks 219 to an external surface. micro radios 220 may be mounted on the internal surfaces of one or both of the side walls 232 of enclosure 212.

The enclosure 212 includes an inward-turned flange 238 and an outwardly extending lip 239. The outwardly extending lip 239 is joined to an inner periphery of flange 238, and defines an opening through which an interior of the enclosure 212 may be accessed. Internal cover 214 has a lip 215 around its perimeter, and is dimensioned to enclose lip 239. In one embodiment, resilient seals may be included in the interface between lip 239 and lip 215. The resilient seals may provide environmental sealing, RF shielding, or both. Also, internal cover 214 may be attached to enclosure 212 by a hinge 217 running lengthwise along enclosure 212, allowing internal cover 214 to swing open and closed.

Alternately, the enclosure 212 may be configured with Z-shaped walls, as illustrated in earlier embodiments, provided that the lower side walls have sufficient area on which to mount micro radios and heat sinks. The electronics of this embodiment are similar to previously-described embodiments.

The Panel Antenna 210 includes a communications hub 250, a power supply (not illustrated), and a calibration radio 254. Interconnections between the communications hub, power supply, and calibration radio are protected from adverse environmental conditions by the enclosure 212, internal cover 214, lip 215 and lip 239. The communications hub 250, power supply and calibration radio 254 may be mounted on rear panel 230 and be thermally coupled to rear heat sinks 218.

Figure 6:
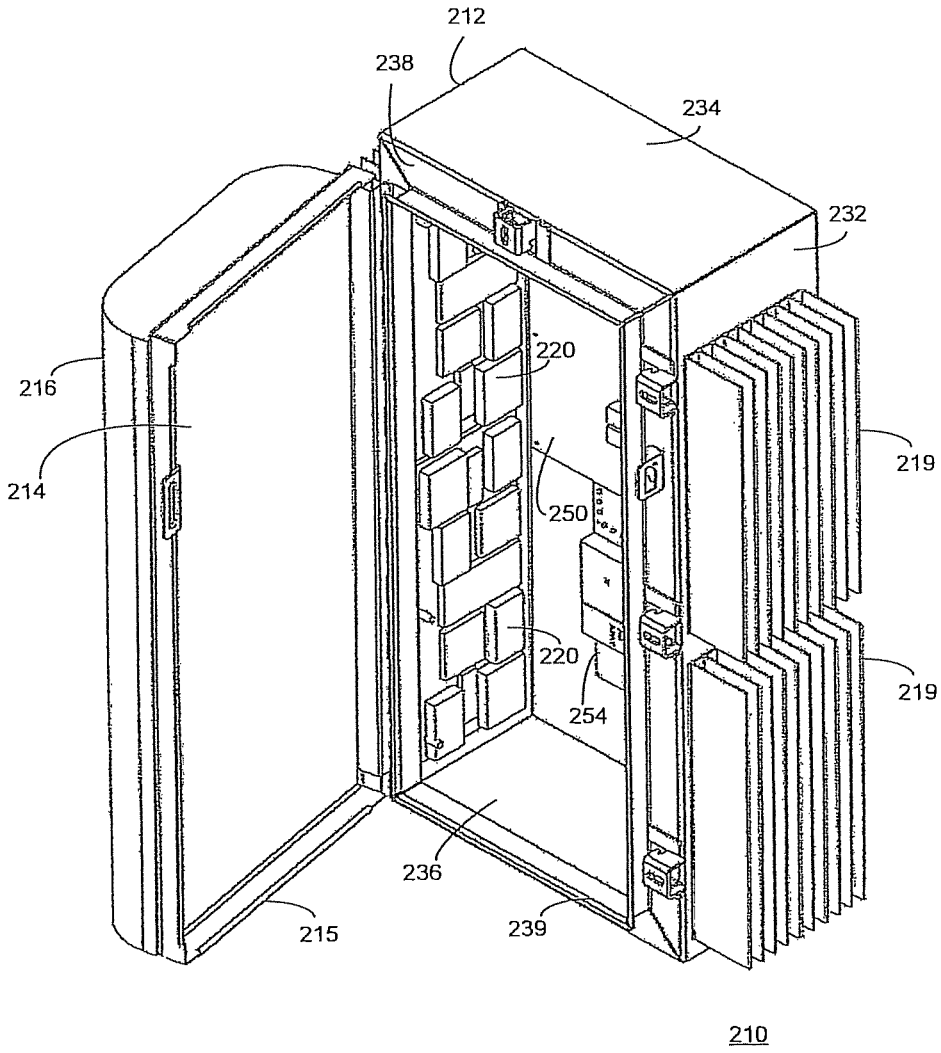
FIG. 6 is a perspective view of another example of a panel antenna according to another aspect of the present invention.

In the example illustrated in FIGS. 6-9, two RF modules 224 and four micro radios 220 are included. (FIG. 6 illustrates two micro radios 220 on a front side wall; the other two, on the internal surface of the second side wall, are not visible.) Each RF module 224 is coupled to a corresponding pair of micro radios 220. In this example, a first micro radio 220 of a pair of micro radios drives a first radiating element of the corresponding RF module 224, and a second micro radio 220 of the pair of micro radios drives a second radiating element of the corresponding RF module 224. This arrangement may be used, for example, where the RF modules 224 comprise dual polarized radiating elements.

Figure 10:
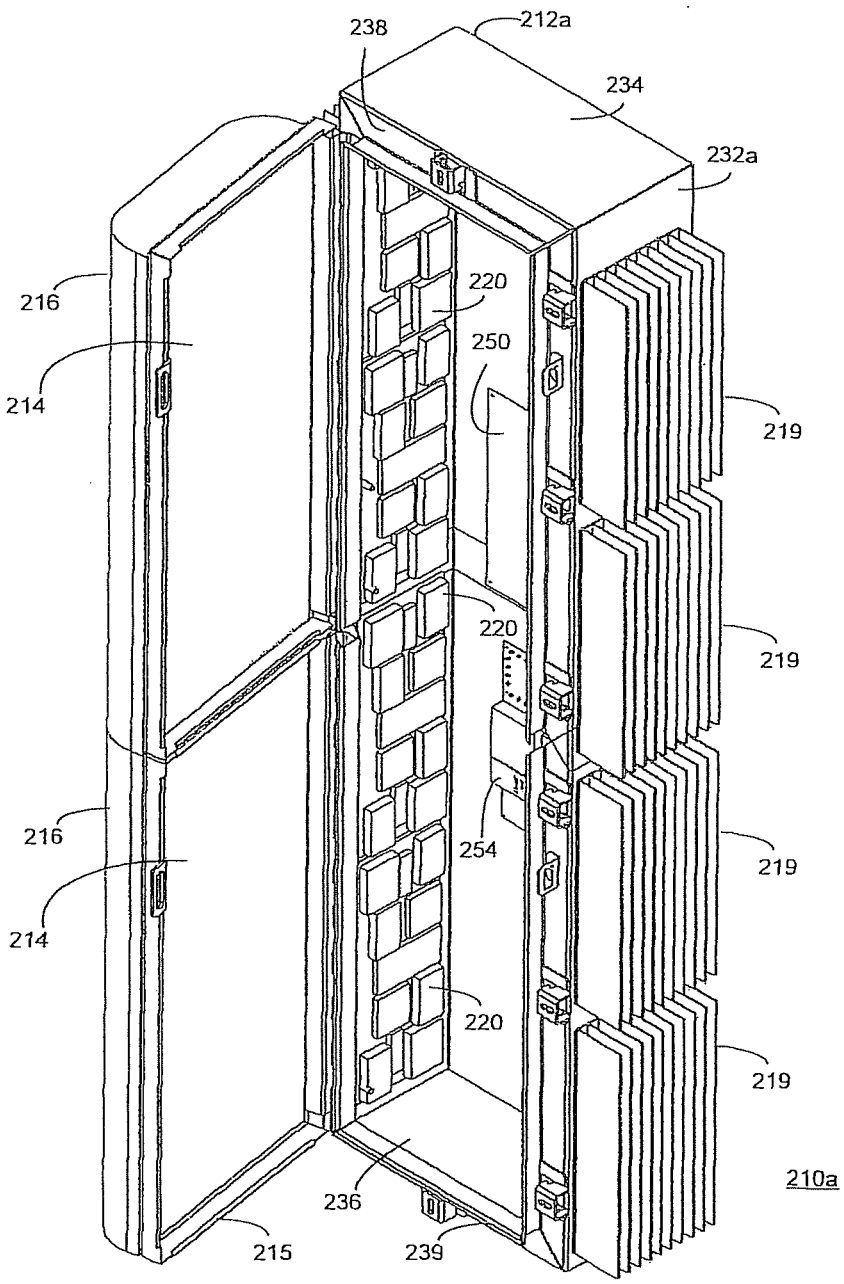
FIG. 10 is a perspective view of another example of a panel antenna according to another aspect of the present invention.
Figure 11:
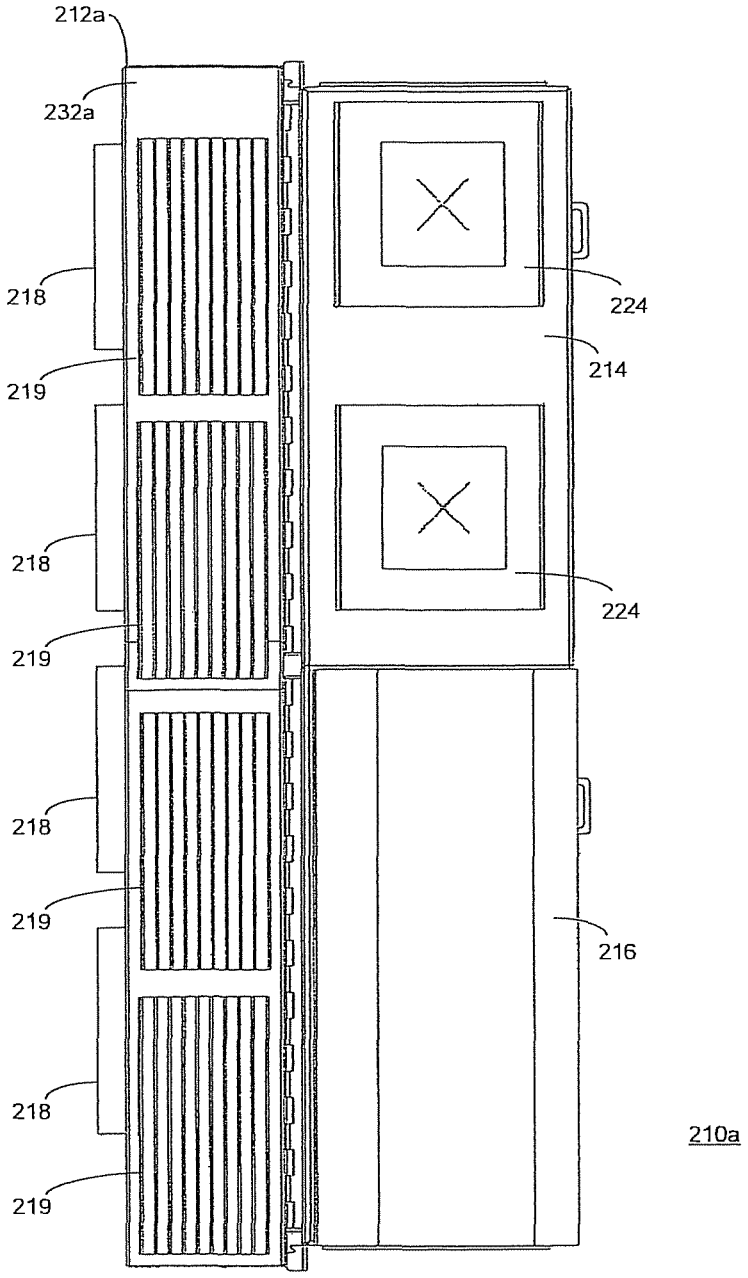
FIG. 11 is a side view of the panel antenna of FIG. 10.

In an alternate example, illustrated in FIGS. 10-11, four RF Modules 224 and eight micro radios 220 are included in panel antenna 210*a*. Other components sharing common reference characters are substantially the same as with the example illustrated in FIGS. 6-9. Panel Antenna 210*a* includes an enclosure 212*a* having longer side walls 232*a* and two internal covers 214 and two radomes 216 (only one radome 216 is illustrated to allow a view of two of the radiating elements 224.) This would allow the internal covers 214 to be opened independently of each other or at the same time. Alternately, a single internal cover and radome may be used.

Each micro radio 220 is also connected to the communications hub 250. The communications hub 250 is connected to Base Station Equipment (BSE) (not illustrated). A digital signal may be provided by the Base Station Equipment to the communications hub 250. For example, a fiber optic link or other digital transmission medium may provide the connection between the BSE and the communications hub 250. Typically, the communications hub receives digital signals from the BSE, comprising information for RF transmission by the Panel Antenna 210*a*, and transmits digital signals to the BSE, comprising information received by RF signal by the Panel Antenna 210*a*.

The connection between the communications hub 250 and each micro radio 220 may be the same as described above with respect to the earlier embodiments. Additionally, the micro radios 220 may operate as described with respect to micro radios 20, above.

Internal cover 214 may be manufactured from a sheet of aluminum. Other materials such as stainless steel and powder-coated steel may be used for internal cover 214. The material is selected to provide both an environmental seal and an electromagnetic shield. In this example, internal cover 214 protects the micro radios 220 and other electronics in the Panel Antenna 210 or 210*a* from moisture and other environmental hazards, and shields the micro radios 220 and other electronics from the electromagnetic transmissions of the RF modules 224. The RF modules 224, as passive devices, need not be as effectively sealed from the elements as the active electronics. RF signals are carried between the RF modules 224 and micro radios 220 on cables (not shown). The cables may pass through sealed apertures in the internal cover 214.

The internal cover 214 may also serve as a structural support for the RF modules 224. The RF modules may include a plurality of radio frequency radiating elements. In one illustrated example, the internal cover 214 supports two RF modules 224. As set forth above, in one example, the RF modules 224 comprise patch antennas, and in particular, dual polarized patch antennas. Alternatively, the RF modules may comprise dipole or cross-dipole antenna elements. In some embodiments, radiating elements may be disposed over a pan-shaped reflector. In other embodiments, radiating elements may be disposed over a ground plane. In some embodiments, internal cover 214 may serve as a ground plane or reflector.

As with the examples given above, an example of a suitable patch antenna may be found in International Application WO 2006/135956 A1, which in incorporated by reference.

While in the examples above, the internal cover 214 may be mounted to enclosure 212 by hinge 217, other mounting arrangements for internal cover 214 are contemplated, including the internal cover 14 mounting arrangements set forth with respect to enclosure 12 above, such as a flange and seal arrangement.

The radome 216 is mounted to the internal cover 214. Alternatively, the radome 216 may include flanges (not illustrated) to engage and slide over edges defined by a flange of the enclosure 212, or edges of the internal cover 214, or both. Alternatively the radome 216 includes mounting apertures (not illustrated) through which fastening devices may pass.

In an alternative embodiment, the enclosure 212 may be combined with the radio modules 122 and RF modules 124 of Panel Antenna 110, described above. In this example, the RF modules 124 would be installed in a radome to comprise a radome assembly.

An advantage of the above examples, electronic components, such as the micro radios 220, may be accessed without disturbing the location of the RF modules 224 with respect to the internal cover 214 or the radome 216. However, the RF modules 224 may be removed from the radome assembly if service is required.

What is claimed is:

1. A panel antenna, comprising:

an enclosure, the enclosure including a rear panel, a first side wall, and a second side wall, a top wall and a bottom wall, the rear panel and the walls defining a cavity, the walls further defining an aperture through which the cavity of the enclosure may be accessed, an internal cover, the internal cover being dimensioned to overlap an area defined by the aperture of the enclosure and providing an environmental seal and electromagnetic shielding for the cavity, the internal cover having at least one RF radiating module fastened to an exterior surface thereof, at least one micro radio mounted to an internal surface of the first side wall, the micro radio being coupled to the RF radiating module;

a first heat sink, mounted to an external surface of the first side wall, and a radome, the radome mounting to the internal cover and enclosing the RF radiating module;

wherein a flange joins the first and second side walls and the top and bottom wall, and a lip extends from the flange, further defining the aperture through which the cavity of the enclosure may be accessed, the lip being engaged by the internal cover to provide the environmental seal.

2. The panel antenna of claim 1, wherein the panel antenna further comprises: a second micro radio, the second micro radio mounted to an internal surface of the second side wall, a plurality of RF radiating modules, a second heat sink mounted on an exterior surface of the second side wall.

3. The panel antenna of claim 2, wherein each RF radiating element is dual polarized and is associated with two micro radios.

4. The panel antenna of claim 1, further comprising a communications hub coupled to each micro radio.

5. The panel antenna of claim 4, further comprising a calibration radio.

6. The panel antenna of claim 5, wherein the communications hub and calibration radio are mounted on an interior surface of the rear panel, and a rear heat sink is mounted on an exterior surface of the rear panel.

7. The panel antenna of claim 1, wherein a flange joins the first and second side walls and the top and bottom wall, further defining the aperture through which the cavity of the enclosure may be accessed.

8. A cellular base station antenna, comprising:

an active radio enclosure, the active radio enclosure including a rear panel, a first side wall, and a second side wall, a top wall and a bottom wall, the rear panel and the walls defining a cavity, the walls further defining an aperture through which the cavity of the active radio enclosure may be accessed;

at least one active radio component mounted inside the cavity, on the rear panel;

a heat sink mounted on an external surface of the rear panel;

an internal cover mounted to the aperture, the internal cover being dimensioned to overlap an area defined by the aperture of the active radio enclosure;

a passive radio enclosure including a radome, the passive radio enclosure being defined by the radome and an exterior surface of the internal cover; and at least one passive radio element mounted inside the passive radio enclosure;

wherein the active radio enclosure and internal cover provide environmental sealing and electromagnetically shielding for the active radio component; and wherein the internal cover is mounted to the active radio enclosure by a hinge, so that the active radio components may be accessed without disturbing the location of the radome or RF modules with respect to the internal cover.

9. The cellular base station antenna of claim 8, wherein the active radio component further comprises a micro radio and the passive radio element comprises a RF module.

10. The cellular base station antenna of claim 8, wherein the active radio component further comprises at least two micro radios and the passive radio element comprises a dual polarized RF module, wherein a first micro radio is coupled to a first radiating element of the dual polarized RF module, and a second micro radio is coupled to a second radiating element of the dual polarized RF module.

11. The cellular base station antenna of claim 8, wherein the active radio component further comprises a plurality of micro radios and the passive radio element comprises a plurality of RF modules.

12. The cellular base station antenna of claim 8, wherein the internal cover is fabricated from a sheet of aluminum.

13. The panel cellular base station antenna of claim 8, wherein the active radio component further comprises:

a micro radio, a communications hub coupled to the micro radio, and a calibration radio.

14. The panel cellular base station antenna of claim 8, further comprising a plurality of micro radios mounted on the first side wall and the second side wall, and wherein the active radio component further comprises a communications hub coupled to the micro radios.

15. The cellular base station antenna of claim 8, wherein the passive radio component further comprises a plurality of RF modules mounted to the outer surface of the internal cover.

16. The cellular base station antenna of claim 8, wherein a flange joins the first and second side walls and the top and bottom wall, and a lip extends from the flange, further defining the aperture through which the cavity of the enclosure may be accessed, the lip being engaged by the internal cover to provide the environmental seal.

17. The cellular base station antenna of claim 8, wherein the radome of the passive radio enclosure does not provide environmental sealing or electromagnetic shielding for the passive radio element.

* * * * *